United States Patent [19]

Hayashi

[11] Patent Number: 4,999,602

[45] Date of Patent: Mar. 12, 1991

[54] RESISTOR FOR AUDIO/VIDEO SIGNAL CIRCUIT

[75] Inventor: Naotake Hayashi, Tokyo, Japan

[73] Assignee: Stax Industries Limited, Tokyo, Japan

[21] Appl. No.: 223,326

[22] Filed: Jul. 25, 1988

Related U.S. Application Data

[60] Continuation-in-part of Ser. No. 172,176, Mar. 23, 1988, which is a division of Ser. No. 776,052, Aug. 29, 1985, Pat. No. 4,741,041, and a continuation-in-part of Ser. No. 931,589, Oct. 27, 1986.

[30] Foreign Application Priority Data

Dec. 29, 1983 [JP] Japan ..... 58-252058
Feb. 27, 1984 [JP] Japan ..... 60-36604

[51] Int. Cl.[5] ..... H01C 1/012

[52] U.S. Cl. ..... 338/308; 338/309; 338/332

[58] Field of Search ..... 338/308, 309, 314, 327, 338/328, 322, 332; 29/670; 156/656

[56] References Cited

U.S. PATENT DOCUMENTS

| | | | |
|---|---|---|---|
| 4,150,355 | 4/1979 | Neff et al. | 338/332 |
| 4,159,459 | 6/1979 | Sease et al. | 338/61 |
| 4,199,706 | 4/1980 | Bing et al. | 338/332 X |
| 4,268,954 | 5/1981 | Sease et al. | 29/620 |

*Primary Examiner*—C. L. Albritton
*Attorney, Agent, or Firm*—Sughrue, Mion, Zinn, Macpeak & Seas

[57] ABSTRACT

A highly accurate resistor for audio/video signal circuits is disclosed, and includes a substantially cylindrical substrate composed of dielectric material, such as ceramics, and a film layer of resistive material, such as tantalum with high purity. The film layer is arranged exclusively on the outer peripheral surface of the substrate such that the dielectric material is exposed on both end surfaces of the substrate. Undesirable eddy currents are prevented or suppressed from being induced on the end surfaces of the substrate as audio/video signal current is supplied to and conducted through the resistor, realizing a significant improvement in the high fidelity or definition of the reproduced sound/picture image.

14 Claims, 2 Drawing Sheets

RESISTOR FOR AUDIO/VIDEO SIGNAL CIRCUIT

CROSS-REFERENCE TO RELATED APPLICATIONS

This application is a continuation-in-part application of copending U.S. Ser. No. 07/172,176 filed Mar. 23, 1988, which, in turn, is a divisional application of U.S. Ser. No. 06/776,052 filed Aug. 29, 1985, now U.S. Pat. No. 4,741,041.

This application is also a continuation-in-part application of copending U.S. Ser. No. 06/931,589 filed Oct. 27, 1986.

BACKGROUND OF THE INVENTION

1. Field of the Invention

The present invention relates to a resistor for high-fidelity audio/video signal circuits; more particularly, it pertains to a novel resistor whereby the characteristic of audio/video signal current conducted therethrough can be effectively prevented from undesirable degradation.

2. Description of the Related Art

With a recent significant improvement in the reproduced sound/picture image quality of audio/video equipments, various proposals have hitherto been made with respect to novel material and/or arrangement of highly accurate electronic components for such equipments. Among others, known proposals include application of high-quality wire material for signal conductors, such as large- or mono- crystal oxygen-free copper, and also application of accurate resistors or the like circuit elements with excellent linearity, both to high grade audio/video circuit.

As a basic circuit element, so-called metal film resistors are widely used and include a substrate made of dielectric material, usually a ceramic material with a solid or hollow cylindrical configuration, and a resistive metal film layer formed on the outer surface of the substrate. This type of resistor is generally believed to provide excellent linearity and to be thus very accurate.

However, even by adopting the above-mentioned measures in an attempt to improve reproduced sound/picture image quality, it can be clearly recognized by a number of enthusiastic users that there still remains a delicate difference between the reproduced sound and original sound, in case of audio equipments, which can be clearly discriminated by the human ear, and that the reproduced picture image quality of video equipments needs to be further refined to achieve the desired high definition. Consequently, there have been strong demands for still positive measures, including those related to resistors or the like circuit elements, which make it possible to further improve the high fidelity and definition of the reproduced sound/picture image.

SUMMARY OF THE INVENTION

It is therefore an object of the present invention to provide a novel resistor for audio/video signal circuits, which is capable of suppressing or minimizing undesirable degradation of audio/video signal current.

According to the present invention, there is provided a resistor which comprises: a substrate consisting essentially of dielectric material, with a substantially cylindrical outer peripheral surface and a pair of end surfaces; a resistive material layer arranged substantially exclusively on the outer peripheral surface of the substrate, whereby the end surfaces of the substrate are not covered by the resistive material layer, with the dielectric material of the substrate being exposed on the end surfaces; and a pair of terminal end regions in contact with the resistive material layer on the outer peripheral surface of the substrate, each terminal end region being composed of a material with a relatively low resistivity as compared with the resistive material.

Conventionally, the resistive metal film layer of a resistor is deposited by a sputtering process or making use of a CVD device, etc., onto the entire outer surfaces of the cylindrical substrate; hence, it is present on both end surfaces, too. The present invention is based on an experimental recognition that, in case of a metal film type resistor, formation of the end surfaces of the substrate without the resistive material layer realizes a remarkable improvement in the high fidelity or high definition of the reproduced sound/picture image.

In other words, the deposited metal film layer, when left on the end surfaces of the cylindrical substrate, substantially degrades the signal current and adversely affects realization of the high fidelity or definition of the reproduced sound/picture image, by permitting undesirable eddy currents to be induced on the end surfaces of the substrate as the audio/video signal current is supplied to, and conducted through the resistor. The problematic degradation of the signal current based on such a mechanism can be readily and effectively avoided or at least minimized by the above-mentioned arrangement of the present invention.

A particularly advantageous embodiment of the present invention features an arrangement, wherein the terminal end regions are formed to have an initially annular cross-section, as seen in a plane which is at right angles to the longitudinal direction of the substrate, and each terminal end region is then formed with a slit extending in the longitudinal direction of the substrate, such that the material of the terminal end regions has an open cross-section in the above-mentioned plane. Formation of such slits further serves to prevent or suppress eddy currents from being induced circumferentially along the end terminals, which would otherwise significantly deteriorate the desired high fidelity or definition of the reproduced sound/picture image.

DETAILED EXPLANATION OF THE PREFERRED EMBODIMENTS

Figure 1:
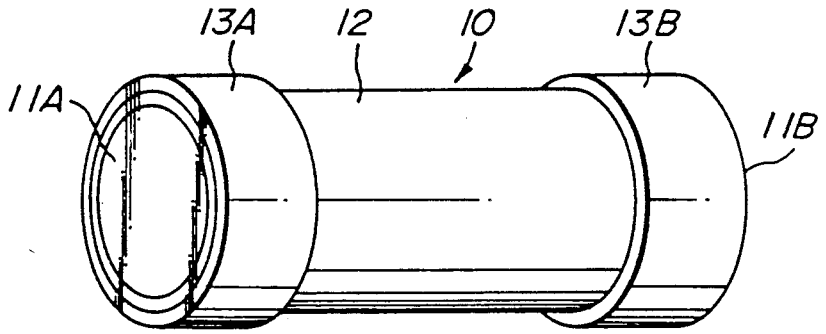
FIG. 1 is a perspective view of the resistor according to one embodiment of the present invention.

The present invention will now be explained in further detail, by referring to some preferred embodiments shown in the drawings.

Figure 2:
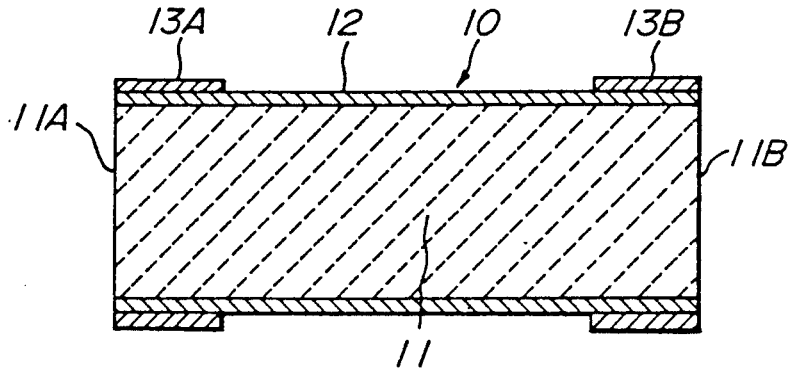
FIG. 2 is a longitudinal-sectional view of the resistor of FIG. 1.

There is shown, in FIGS. 1 and 2, a metal film resistor 10 according to one embodiment of the present invention. The resistor 10 includes a solid cylindrical substrate 11 which consists essentially of a dielectric material having excellent electrical and thermal properties, i.e. low dielectric loss (tanδ), high thermal conductivity, and sufficient heat durability. Hence, the dielectric material may be ceramic, such as alumina, ceramic glass, or may be sapphire, diamond, amorphous silica glass, etc.

The resistor 10 also includes a film layer 12 of an appropriate resistive material, which is arranged exclusively on the outer peripheral surface of the substrate 11 so that the film layer 12 is not present on both axial end surfaces 11A, 11B of the substrate 11. The resistive material forming the film layer 12 may be tantalum with a high purity, tantalum nitride, nickel chromium alloy, or other suitable non-magnetic metal or alloy. Thus, the substrate 11 should also exhibit a good adhesion to the film layer 12. The film layer 12 may, for example, be formed initially on the entire outer surface of the substrate 11 by sputtering process or by using a CVD device, in a conventional manner. The film layer 12 is then subjected to removal from the end surfaces 11A, 11B of the substrate 11 by appropriate machining, to expose the bare material surface of the substrate 11 on these ends.

The resistor 10 further includes a pair of terminal ends 13A, 13B arranged on both axial end regions of the outer peripheral surface of the substrate 11. These terminal ends 13A, 13B are shown as being a copper film formed on the resistive material film layer 12 by sputtering process, to substantially completely surround the outer peripheral surface without, however, covering the end surfaces 11A, 11B of the substrate 11.

The resistor 10 of the above-mentioned embodiment is adapted to be used in various audio/video signal circuits to provide the desired high fidelity and/or definition of the reproduced sound/picture image. Indeed, the inventor has carried out careful comparisons of the quality of sound and picture images, both reproduced by using the above-mentioned resistor 10 of the present invention, and also a metal film resistor of conventional structure with virtually the same specification. As a result, it has been clearly revealed that, in case of audio signal reproduction, the resistor of the present invention provides a higher fidelity of the reproduced sound in that it is more enriched in the low frequency range, with impurities or uncleanness in the medium and high frequency ranges being suppressed within a satisfactory level. The comparison further revealed that, in case of video signal reproduction, the resistor of the present invention provides a higher definition of the reproduced picture image, i.e. significantly improved resolution, sharpness and fineness thereof.

The improvement achieved by the above-mentioned embodiment of the resistor 10 is mainly due to the removal of the resistive material film layer 12 from the end surfaces 11A, 11B of the substrate 11, which ensures that undesirable eddy currents are effectively prevented or suppressed from being induced on the end surfaces 11A, 11B of the substrate 11 as audio/video signal current is supplied to, and conducted through the resistor 10.

Figure 3:
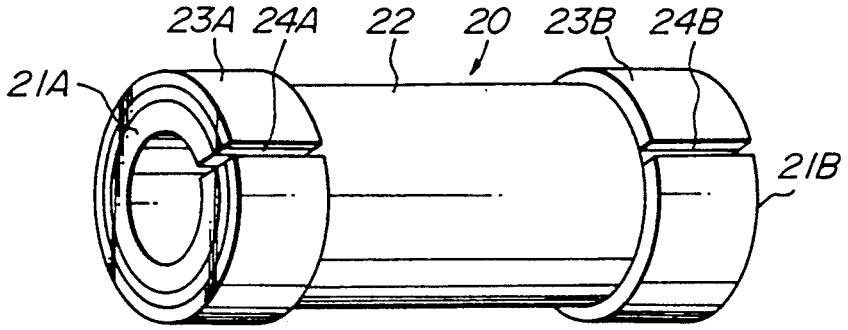
FIG. 3 is a perspective view of the resistor according to another embodiment of the present invention.
Figure 4:
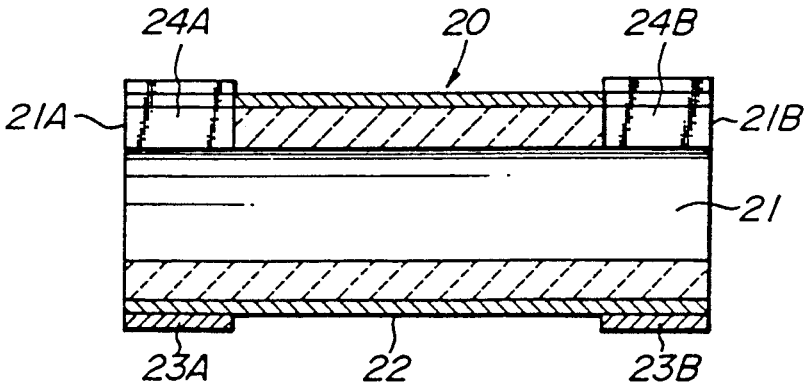
FIG. 4 is a longitudinal-sectional view of the resistor of FIG. 3.

Another embodiment of the present invention is shown in FIGS. 3 and 4, wherein the resistor designated as a whole by reference numeral 20 includes a hollow cylindrical substrate 21 with substantially annular end surfaces 21A, 21B, a resistive material film layer 22 formed exclusively on the other peripheral surface of the substrate 21, and terminal ends 23A, 23B on both axial end regions of the outer peripheral surface of the substrate 21. These elements are constructed and arranged basically in the same manner as in the resistor 10 of the previous embodiment explained with reference to FIGS. 1 and 2. Thus, the annular end surfaces 21A, 21B are subjected to removal of the resistive material film layer 22, to expose these end surfaces.

In the present embodiment, each terminal end 23A, 23B is formed, e.g. by laser cutting process, with a slit 24A, 24B which extend longitudinally along the generatrix of the cylindrical substrate 21. In order to facilitate the manufacturing process, such slits 24A, 24B may extend radially inwardly up to the inner peripheral surface of the substrate 21. Formation of the longitudinal slits 24A, 24B in the terminal ends 23A, 23B ensures that each terminal end has a non-closed cross-section in a plane at right angles to the longitudinal axis of the resistor 20.

The resistor 20 of this embodiment, too, is adapted to be used in various audio/video signal circuits, and has actually been confirmed to provide still higher fidelity and/or definition of the reproduced sound/picture image, even when compared with the resistor 10 of the previous embodiment. Thus, bedsides the removal of the resistive material film layer 22 from the annular end surfaces 21A, 21B of the substrate 21, the extremely high fidelity and definition achieved by the present embodiment are due to the additional formation of the slits 24A, 24B in the terminal ends 23A, 23B, which ensures that undesirable eddy currents are effectively prevented or suppressed from being induced circumferentially around the terminal ends 23A, 23B, as audio/video signal current is supplied to, and conducted through the resistor 20.

Figure 5:
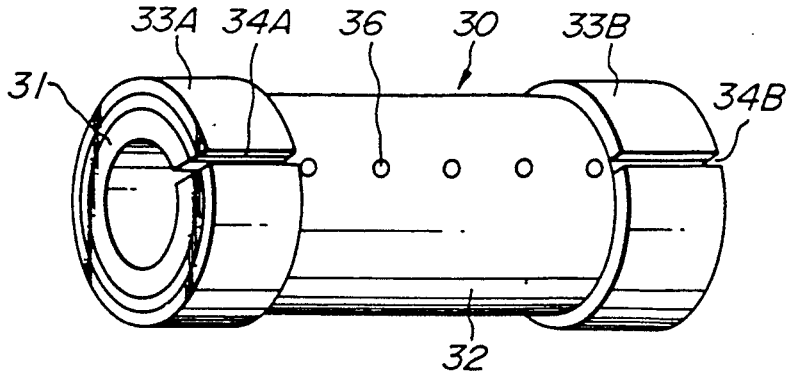
FIG. 5 is a perspective view showing one side of the resistor according to still another embodiment of the present invention.
Figure 6:
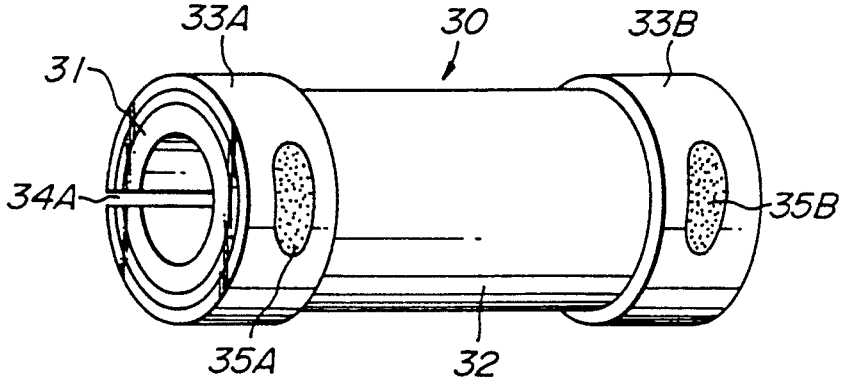
FIG. 6 is a perspective view showing the other side of the resistor of FIG. 5.
Figure 7:
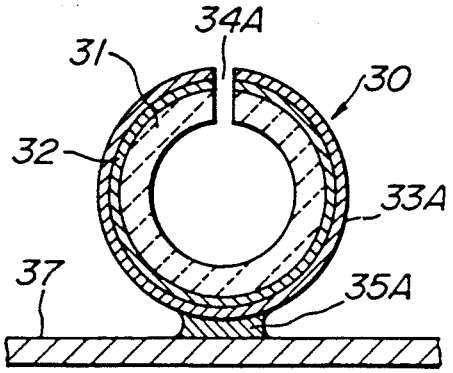
FIG. 7 is a cross-sectional view of the resistor of FIG. 5, which is shown as being mounted on a circuit board.

A practical embodiment of the present invention is shown in FIGS. 5 to 7, wherein the resistor designated as a whole by reference numeral 30 includes a hollow cylindrical substrate 31 with substantially annular end surfaces, a resistive material film layer 32 formed exclusively on the outer peripheral surface of the substrate 31, terminal ends 33A, 33B on both axial end regions of the outer peripheral surface of the substrate 31, and slits 34A, 34B formed longitudinally in the terminal ends 33A, 33B. These elements are constructed and arranged basically in the same manner as in the resistor 20 of the previous embodiment explained with reference to FIGS. 3 and 4.

In this embodiment, the terminal ends 33A, 33B of the resistor 30 consist of copper films each provided with a soldering spot 35A, 35B. Each soldering spot 35A, 35B is formed of a solder material paste on the copper film, which is arranged at a diametrically opposite location with respect to the relevant slit 34A, 34B. The resistor 30 further includes a coded portion 36 of appropriate color and/or arrangement, which is substantially aligned with the slits 34A, 34B such that the coded portion 36 serves as a visual indication of circumferential location of the slits 34A, 34B.

More particularly, as shown in FIG. 7, when the resistor 30 is to be incorporated into a circuit board 37 of an audio/video signal circuit, the resistor 30 is angularly oriented about its longitudinal axis such that the soldering spots 35A, 35B are opposed to the circuit board 37, with the slits 34A, 34B being spaced from the circuit board 37 or oriented upwardly in FIG. 7. Such an angular orientation of the resistor 30 can be readily achieved by confirming that the cored portion 36 is remote from the circuit board 37. Then, the desired connection of the resistor 30 to the circuit board 37 can be effected in a conventional manner, by applying heat to the soldering spots 35A, 35B to thereby bring the solder material into a molten state. During such connection of the resistor 30, the above-mentioned proper orientation of the resistor 30 effectively prevents the slits 34A, 34B from being inadvertently short-circuited by the solder material.

It will be readily appreciated from the foregoing description that, in accordance with the present invention, the resistor for various audio/video signal circuits includes a resistive material film layer formed exclusively on the outer peripheral surface of substantially cylindrical substrate. Because the resistive material film layer is not present on the end surfaces of the substrate, undesirable eddy currents are effectively prevented or suppressed from being induced on the end surfaces of the substrate as the audio/video signal current is supplied to and conducted through the resistor. Thus, the present invention makes it possible to realize a remarkable improvement in the high fidelity or definition of the reproduced sound/picture image.

What is claimed is:

1. A resistor for audio/video signal circuit, which comprises:

a substrate consisting essentially of dielectric material, with a substantially cylindrical outer peripheral surface and a pair of end surfaces;

a resistive material layer arranged substantially exclusively on said outer peripheral surface of said substrate, whereby said end surfaces of said substrate are not covered by said resistive material layer, with said dielectric material of said substrate being exposed on said end surfaces; and a pair of terminal end regions in electrical contact with said resistive material layer on said outer peripheral surface of said substrate, each of said terminal end regions being composed of a material with a relatively low resistivity as compared with said resistive material;

said dielectric material of said substrate being a member selected from a group consisting of ceramics, sapphire, diamond and amorphous silica glass.

2. A resistor for audio/video signal circuit, which comprises:

a substrate consisting essentially of dielectric material, with a substantially cylindrical outer peripheral surface and a pair of end surfaces;

a resistive material layer arranged substantially exclusively on said outer peripheral surface of said substrate, whereby said end surfaces of said substrate are not covered by said resistive material layer, with said dielectric material of said substrate being exposed on said end surfaces; and a pair of terminal end regions in electrical contact with said resistive material layer on said outer peripheral surface of said substrate, each of said terminal end regions being composed of a material with a relatively low resistivity as compared with said resistive material;

said substrate being of a hollow cylindrical configuration.

3. A resistor for audio/video signal circuit, which comprises:

a substrate consisting essentially of dielectric material, with a substantially cylindrical outer peripheral surface and a pair of end surfaces;

a resistive material layer arranged substantially exclusively on said outer peripheral surface of said substrate, whereby said end surfaces of said substrate are not covered by said resistive material layer, with said dielectric material of said substrate being exposed on said end surfaces; and a pair of terminal end regions in electrical contact with said resistive material layer on said outer peripheral surface of said substrate, each of said terminal end regions being composed of a material with a relatively low resistivity as compared with said resistive material;

said resistive material being a member selected from a group consisting of tantalum with a high purity, tantalum nitride, and nickel chromium alloy.

4. The resistor as claimed in claim 1, wherein said terminal end regions on said outer peripheral surface of said substrate are of generally annular cross-section in a plane which is at right angles to said longitudinal direction of said substrate, and each terminal end region has a slit extending in the longitudinal direction of said substrate such that the material of said terminal end regions has an open cross-section in said plane.

5. The resistor as claimed in claim 2, wherein said terminal end regions on said outer peripheral surface of said substrate are of generally annular cross-section in a plane which is at right angles to said longitudinal direction of said substrate, and each terminal end region has a slit extending in the longitudinal direction of said substrate such that the material of said terminal end regions has an open cross-section in said plane.

6. The resistor as claimed in claim 3, wherein said terminal end regions on said outer peripheral surface of said substrate are of generally annular cross-section in a plane which is at right angles to said longitudinal direction of said substrate, and each terminal end region has a slit extending in the longitudinal direction of said substrate such that the material of said terminal end regions has an open cross-section in said plane.

7. The resistor as claimed in claim 2, wherein said dielectric material of said substrate is a member selected from a group consisting of ceramics, sapphire, diamond and amorphous silica glass.

8. The resistor as claimed in claim 3, wherein said dielectric material of said substrate is a member selected from a group consisting of ceramics, sapphire, diamond and amorphous silica glass.

9. The resistor as claimed in claim 1, wherein said substrate is of a hollow cylindrical configuration.

10. The resistor as claimed in claim 3, wherein said substrate is of a hollow cylindrical configuration.

11. The resistor as claimed in claim 1, wherein said substrate is of a solid cylindrical configuration.

12. The resistor as claimed in claim 3, wherein said substrate is of a solid cylindrical configuration.

13. The resistor as claimed in claim 1, wherein said resistive material is a member selected from a group consisting of tantalum with a high purity, tantalum nitride, and nickel chromium.

14. The resistor as claimed in claim 2, wherein said resistive material is a member selected from a group consisting of tantalum with a high purity, tantalum nitride, and nickel chromium.

* * * * *